US006648805B1

(12) United States Patent
Millis

(10) Patent No.: US 6,648,805 B1
(45) Date of Patent: Nov. 18, 2003

(54) COLLAPSIBLE GRIND BAR

(76) Inventor: Jayme Millis, 6329 MiraLoma St., Las Vegas, NV (US) 89108

( * ) Notice: Subject to any disclaimer, the term of this patent is extended or adjusted under 35 U.S.C. 154(b) by 32 days.

(21) Appl. No.: 10/081,590

(22) Filed: Feb. 20, 2002

(51) Int. Cl.[7] ..... A63B 71/00
(52) U.S. Cl. ..... 482/148; 482/141; 482/905
(58) Field of Search ..... 482/141, 905, 482/7, 904, 131, 49, 39, 40, 191, 142, 143–45, 95–96, 38, 34, 41, 42, 148; 280/608–9, 11.19, 826; D21/198

(56) References Cited

U.S. PATENT DOCUMENTS 3,485,493 A * 12/1969 Pitkanen ..... 272/1
4,378,112 A * 3/1983 Goldstein ..... 272/111
4,691,885 A 9/1987 Lawrance
5,290,209 A 3/1994 Wilkinson
5,527,242 A 6/1996 Gangloff
5,616,102 A * 4/1997 Lahmann ..... 472/34
5,662,556 A 9/1997 Gangloff
5,938,203 A 8/1999 Beckwith, Sr.
6,547,221 B1 * 4/2003 Bork et al. ..... 256/65.01

* cited by examiner

*Primary Examiner*—Nicholas D. Lucchesi
*Assistant Examiner*—Lori Amerson
(74) *Attorney, Agent, or Firm*—Matthew J. Peirce

(57) ABSTRACT

A collapsible rail glide or grind bar for use by skateboarders, in-line skaters, and snowboarders is disclosed. The present invention would be used by such individuals as a surface to skate or glide across or to perform tricks, stunts, or maneuvers. The present invention is fully collapsible and can be easily transported as needed by a single person, with the present invention collapsing to about half of its length. A pair of included supports which are stored on the present invention in the collapsed position are used to fully support the present invention in the extended position, even providing enough support to allow the present invention to be free standing with no fixed attachment to a ground surface.

8 Claims, 4 Drawing Sheets

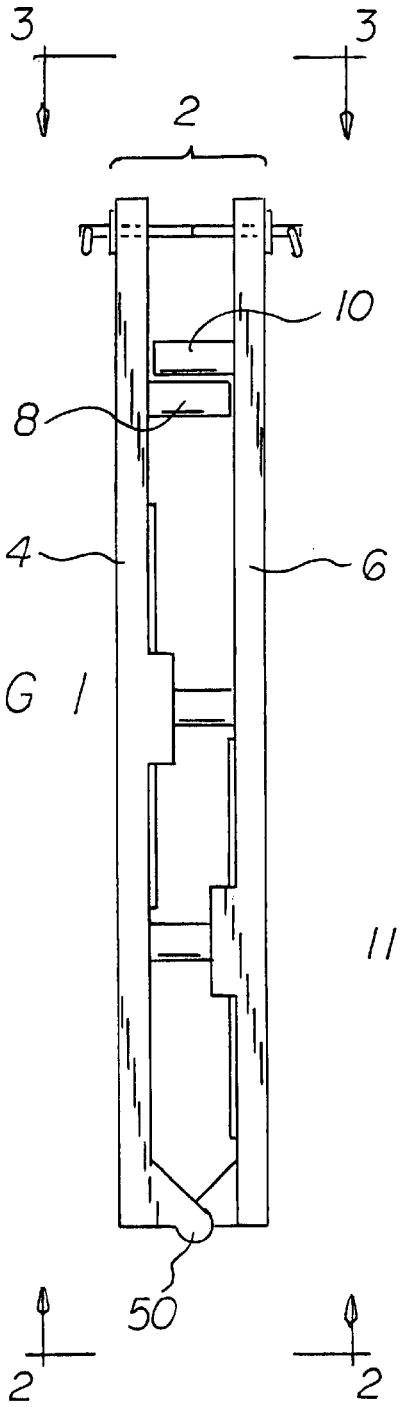
FIG 1
FIG 2
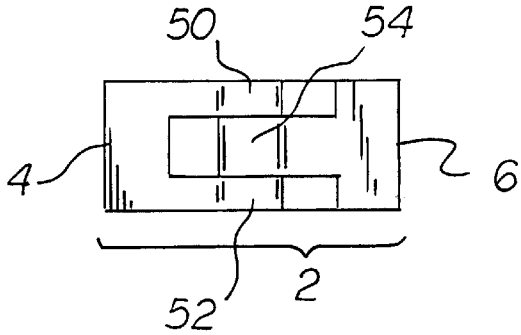
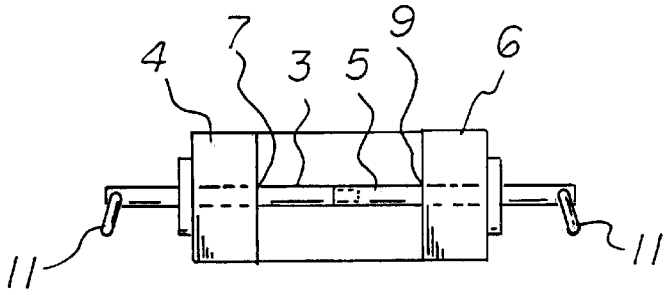
FIG 3

COLLAPSIBLE GRIND BAR

I. BACKGROUND OF THE INVENTION

The present invention is that of a new and improved collapsible piece of athletic equipment used by skateboarders, in-line skaters, and snowboarders.

II. DESCRIPTION OF THE PRIOR ART

U.S. Pat. No. 5,938,203, issued to Beckwith, Sr., discloses a portable target stand and target including base portion.

U.S. Pat. No. 5,662,556, issued to Gangloff, discloses a specially designed foldable exercise apparatus for doing pull-ups or chip-ups while the heels of the feet remain on the floor.

U.S. Pat. No. 5,527,242, issued to Gangloff, discloses a specially designed foldable exercise apparatus for doing pull-ups or chip-ups while the heels of the feet remain on the floor.

U.S. Pat. No. 5,290,209, issued to Wilkinson, discloses a device which is able to develop upper body strength, including doing exercising such as pull-ups, tricep presses, dips, arm curls, flys, etc.

U.S. Pat. No. 4,691,885, issued to Lawrance, discloses a support structure for a display stand.

III. SUMMARY OF THE INVENTION

The present invention is that of a new and improved collapsible rail glide or grind bar used by skateboarders, in-line skaters, and snowboarders. The present invention would be used by such individuals as a surface to skate or glide across or to perform tricks, stunts, or maneuvers. The present invention is fully collapsible and can be easily transported as needed by a single person, with the present invention collapsing to about half of its length. A pair of included supports which are stored on the present invention in the collapsed position are used to fully support the present invention in the extended position, even providing enough support to allow the present invention to be free standing with no fixed attachment to a ground surface.

There has thus been outlined, rather broadly, the more important features of a rail glide or grind bar in order that the detailed description thereof that follows may be better understood and in order that the present contribution to the art may be better appreciated. There are, of course, additional features of the rail glide or grind bar that will be described hereinafter and which will form the subject matter of the claims appended hereto.

In this respect, before explaining at least one embodiment of the rail glide or grind bar in detail, it is to be understood that the rail glide or grind bar is not limited in its application to the details of construction and to the arrangements of the components set forth in the following description or illustrated in the drawings. The rail glide or grind bar is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present rail glide or grind bar. It is important, therefore, that the claims be regarded as including such equivalent constructions insofar as they do not depart from the spirit and scope of the present invention.

It is therefore an object of the present invention to provide a rail glide or grind bar which has all of the advantages of the prior art and none of the disadvantages.

It is another object of the present invention to provide a rail glide or grind bar which may be easily and efficiently manufactured and marketed.

It is another object of the present invention to provide a rail glide or grind bar which is of durable and reliable construction.

It is yet another object of the present invention to provide a rail glide or grind bar which is economically affordable and available for relevant market segments of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

FIG. 1 shows a side view of the collapsible grind bar as it would appear in the collapsible form FIG. 2 shows a closeup front view of the second end of the collapsible grind bar.

FIG. 3 shows a closeup front view of the first end of the collapsible grind bar.

Figure 5:
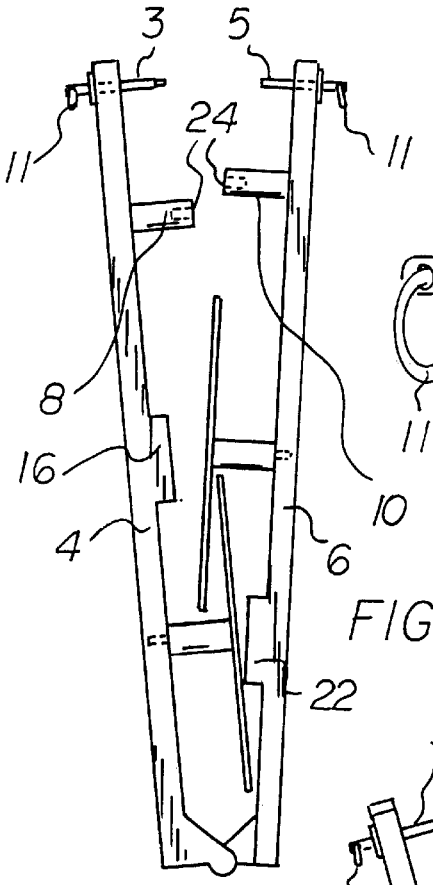
Figure 6:
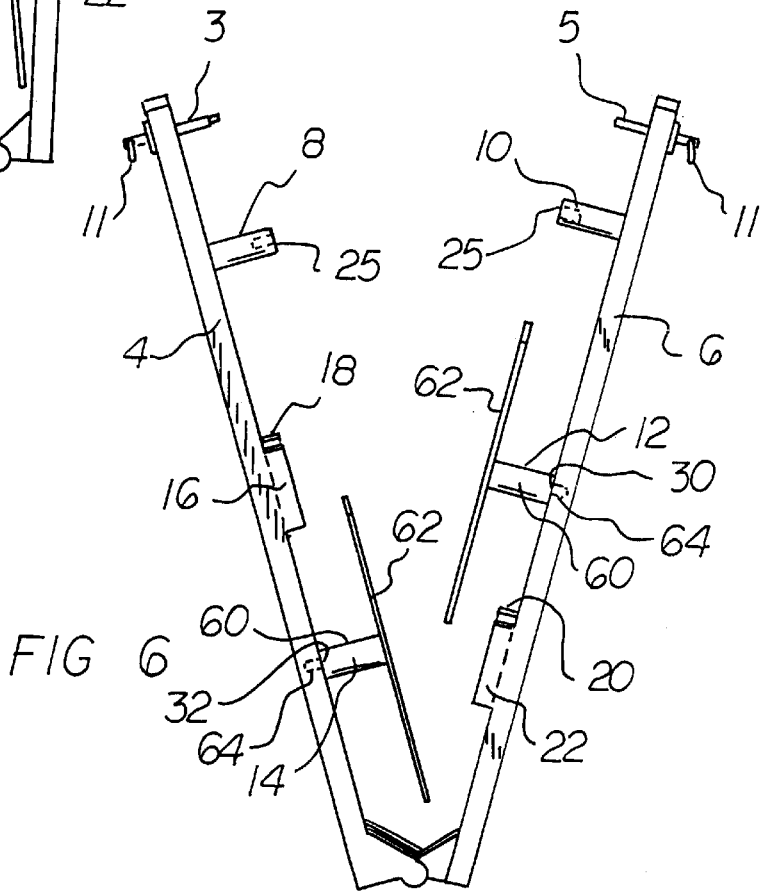
Figure 7:
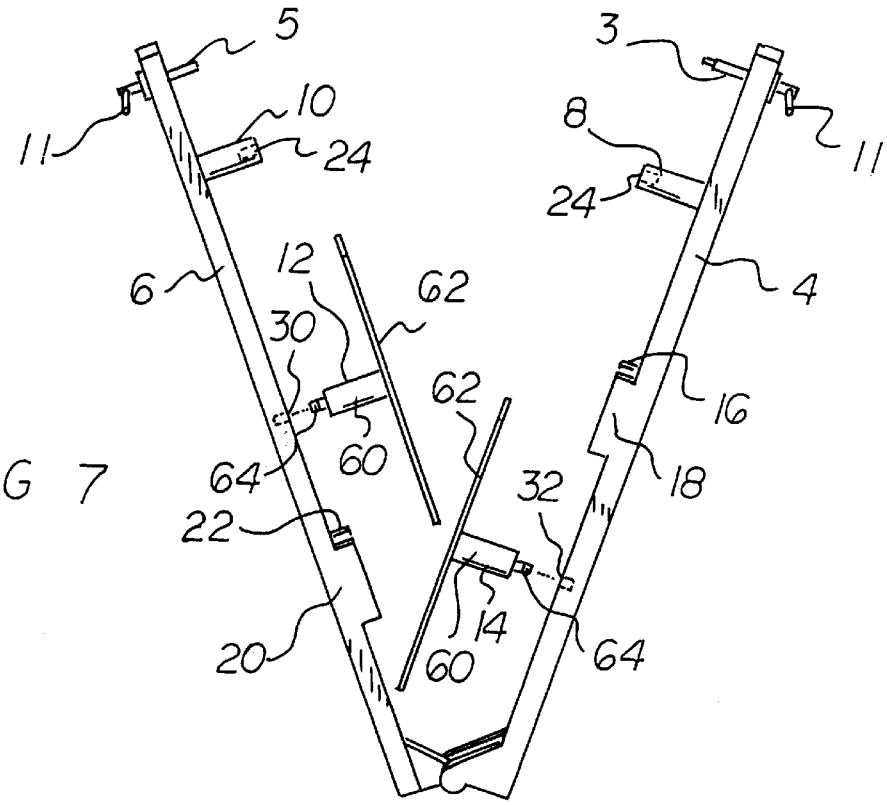

FIGS. 5, 6, and 7 show the collapsible grind bar in various stages of being opened.

Figure 8:
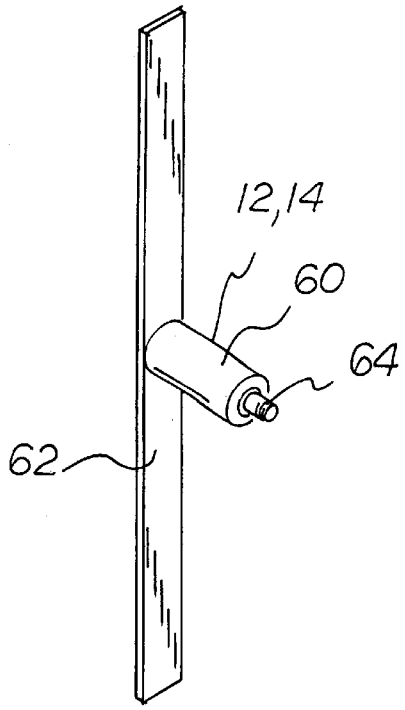

FIG. 8 shows a closeup perspective view of a support used with the collapsible grind bar.

Figure 9:
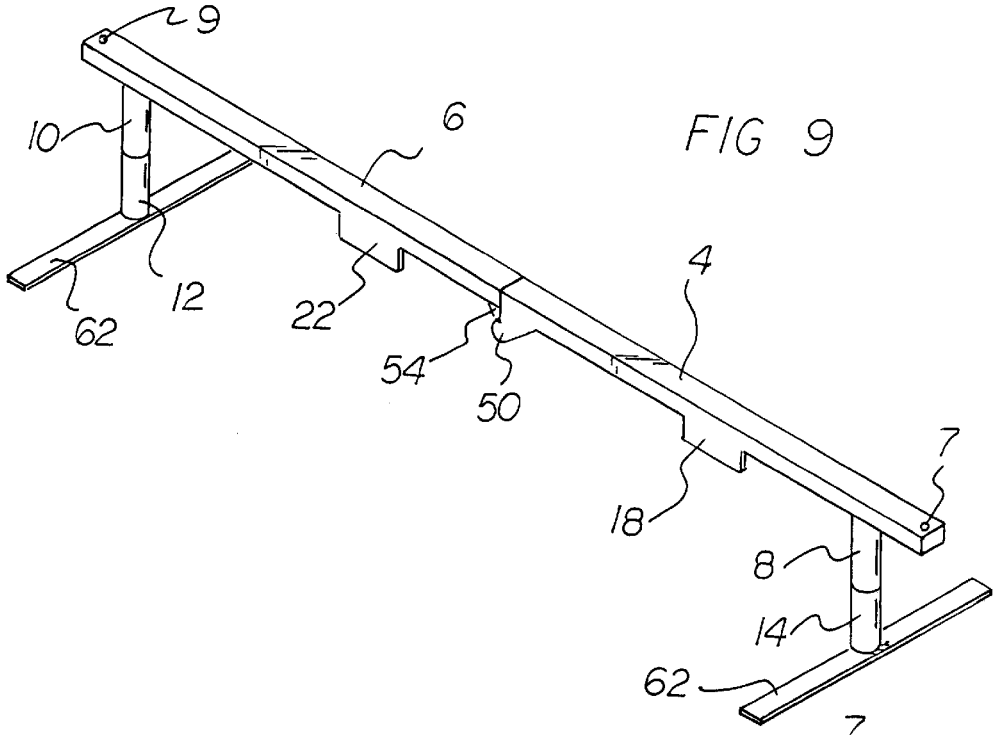
Figure 10:
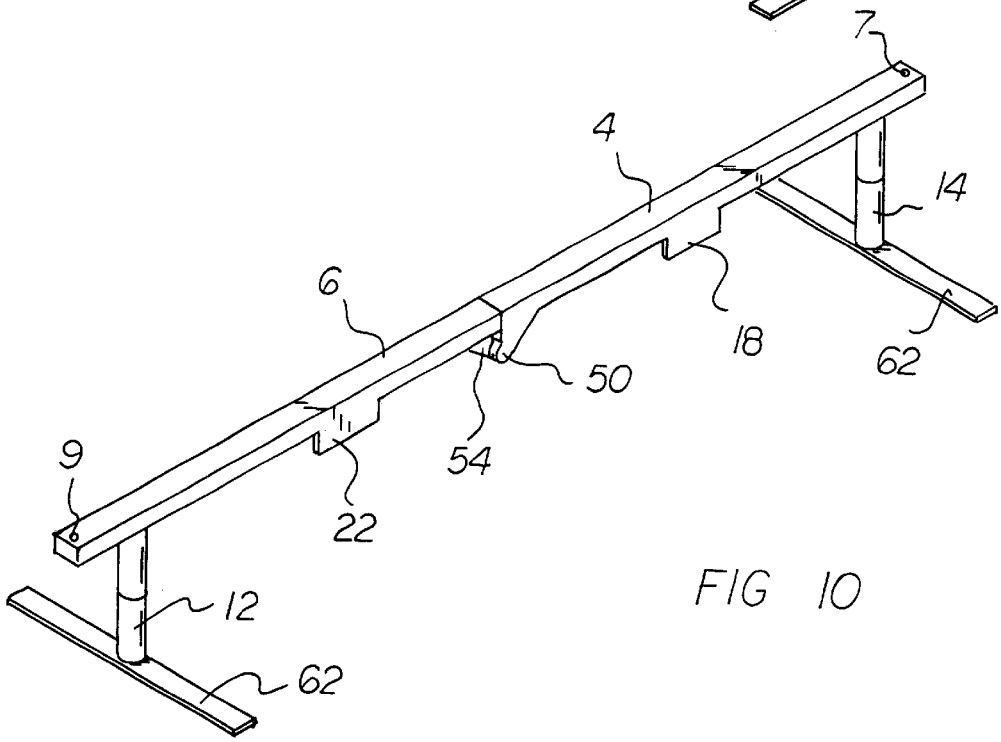

FIGS. 9 and 10 show perspective views of the collapsible grind bar in the open position after the pair of supports have been threadably inserted into the bar support poles.

V. DESCRIPTION OF THE PREFERRED EMBODIMENT

FIG. 1 shows a side view of the grind bar 2 as it would appear in the collapsible form. A grind bar, sometimes also know as a "rail glide" by skateboarders, in-line skaters, and snowboarders, is a product that is commonly used by such individuals in practicing various maneuvers, tricks, and stunts. Grind bars and rail glides are typically available in specially designed parks which are quickly being developed in many cities across the United States. In addition, individuals using skateboards, in-line skates, and snowboards typically can improvise and use existing surfaces as a substitute grind bar or rail glide, such as a stairway rail, bench seat, concrete sculptures, or other flat surfaces that are typically common in parks and outdoor settings.

Grind bar 2, unlike existing prior art, is a portable and mountable grind bar/rail glide that can be fixedly attached to a specific surface for a certain period of time. Grind bar 2 comprises first bar 4 and second bar 6, which are two bars of equal length that each have two ends, a first end and a second end. Both the first bar 4 and second bar 6 has two surfaces, an inner surface and an outer surface, and has a rectangular cross-sectional shape. The dimensions of both the first bar 4 and the second bar 6 would be approximately two inches in height, one inch in width, and thirty-six inches in length. The length of the bars could vary by several inches, as long as the first bar 4 and the second bar 6 would have an equal length. When in the collapsed form, the present invention would have dimensions of approximately thirty-six inches in length, two inches in height, and five and one-half inches in width.

The second end of first bar 4, shown in FIG. 2, would have a pair of connectors 50 and 52 attached to the inner surface of the first bar 4, while the second end of second bar 6 would have a connector 54 attached to the inner surface of the second bar 6. Connectors 50 and 52 would each be roughly triangular in shape and would first connect with the inner surface of the first bar 4 a few inches form the second end of first bar 4 and would extend outward going toward the second end of first bar 4. Connector 50 would be flush or very close to being flush with the first side of the first bar 4, while the connector 52 be flush or very close to being flush with the second side of the first bar 4. Connectors 50 and 52 would culminate in the same plane as the second end of first bar 4. The portion of connector 50 and 52, instead of ending in a triangular tip, would be rounded. There would be enough space in between connectors 50 and 52 to accommodate the placement of connector 54.

Connector 54 would be attached to the second end of the second bar 6 in the same manner as that of connectors 50 and 52. However, connector 54 would be attached to the second end of second bar 6 in between the location of where the connectors 50 and 52 would be placed on the second end of the first bar 4. The outermost portion on connector 54 that would be flush with the second end of second bar 6 would also be rounded. By pivotally mounting connector 54 in between connectors 50 and 52, a user would be able to pivotally attach the second end of the first bar 4 to the second end of the second bar 6. While grind bar 2 is in a completely collapsed form, the first bar 4 and the second bar 6 are parallel to one another. No stopping mechanism is needed for the grind bar 2 when it is opened, as the second end of the first bar 4 and the second end of the second bar 6 butt against one another once the grind bar 2 is opened and the first bar 4 and the second bar 6 would be linearly connected to one another.

Referring again to FIG. 1, grind bar 2 also has first bar support pole 8 and second bar support pole 10 to provide additional support when grind bar 2 is fully opened. Both the first bar support pole 8 and second bar support pole 10 would have two ends, a first end and a second end, with the first end of the first bar support pole 8 being fixedly attached to the inner side of the first bar 4 near the first end of the first bar 4 and the first end of the second bar support pole 10 being fixedly attached to the inner side of the second bar 6 near the first end of the second bar 6. Both the first bar support pole 8 and second bar support pole 10 would have a cylindrical shape and would have a length equal to or less than the length that is present when the grind bar 2 is in a collapsed position, as seen in FIG. 1. First bar support pole 8 and second bar support pole 10 would ideally be placed at similar distances between the first ends of the first bar 4 and second bar 6, respectively, but would have to spaced apart at a distance great enough from one another to ensure that no overlap would be present between first bar support pole 8 and second bar support pole 10 when the grind bar 2 is in a collapsed position.

Figure 4:
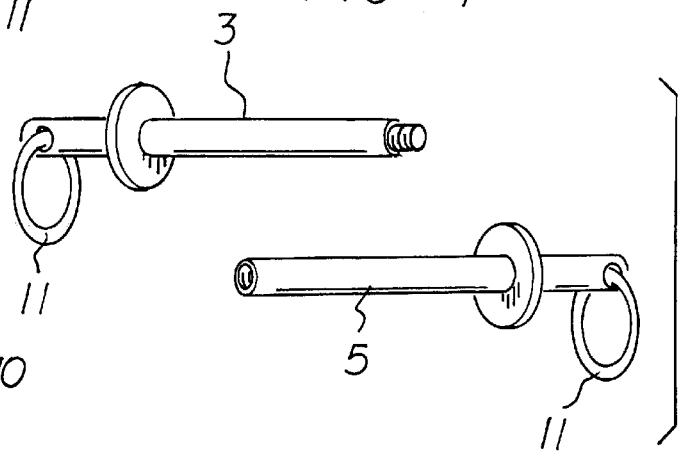
FIG. 4 shows a closeup perspective view of the pins used with the collapsible grind bar.

FIG. 3 shows a closeup front view of the first end of the grind bar 2. The first end of first bar 4 would be removably attached to the first end of the second bar 6 by pins 3 and 5, seen in FIG. 4, which would be insertable through holes 7 and 9, respectively. Hole 7 would be located near the first end of the first bar 4, while hole 9 would be located near the first end of the second bar 6. Each pin would have two ends, an inner end and an outer end, with the inner ends of the pins capable of being threadably attached to one another. The outer ends of each of the pins would preferably have an attached ring 11 to make sure that a pin would not be inserted into a hole too far, and at the same time, to allow an individual to pull the pin out when attempting to open the grind bar 2 from a closed position.

FIGS. 5, 6, and 7, shows the grind bar 2 in various stages of being opened, while FIG. 8 shows a closeup perspective view of a support. Grind bar 2 also comprises two such supports, designated as supports 12 and 14, which would be removably attached to the grind bar 2. Each support comprises a circular section 60 having two ends, a first end and a second end, a base 62 attached to the second end of the circular section 60, and a male threaded member 64 attached to the center of the first end of the circular section 60. In FIGS. 5–7, support 12 is shown as being attached to the inner surface of the second bar 6 approximately halfway between the first end and the second end of the second bar 6, while support 14 is shown as being attached to the inner surface of the first bar 4 significantly closer to the second end of the first bar 4 than the first end of the first bar 4. While placement of supports 12 and 14 in the exact positions shown is not required, one of the supports would have to be attached to an inner surface of a bar about halfway between the ends of that bar, while the other support would have to be attached to an inner surface of the other bar significantly closer to the second end of the other bar than the first end of the other bar. This manner of mounting the supports 12 and 14 on the grind bar 2 is the only manner in which the compactness of the grind bar 2 can be assured.

Support 12 would be kept in place while grind bar 2 would be in a collapsed position by brackets 16 and 18, while support 14 would be kept in place while grind bar 2 would be in a collapsed position by brackets 20 and 22. In addition, the male threaded member 64 on each support would be insertable into a hole 30 located either in about the center of the inner surface of the second bar 6 (for support 12) or into a hole 32 located on the inner surface of the first bar 4 significantly closer to the second end of the first bar 4 than the first end of the first bar 4 (for support 14).

As can be seen looking between FIGS. 5 and 6, one or both of the supports would have to be removed from their attachment holes so that the grind bar 2 could actually be opened up. FIG. 6 shows supports 12 and 14 still attached to the second bar 6 and first bar 4, respectively, while FIG. 7 shows supports 12 and 14 after having been pulled off of their respective bars.

The second end of both the first bar support pole 8 and second bar support pole 10 would each have a centrally located mounting hole 24 which would be threaded. Once the first bar 4 and the second bar 6 had been fully extended, the male threaded member 60 of support 12 would be inserted into one hole 24 and threadably attached, while the male threaded member 60 of support 14 would be inserted into the other hole 24 and threadably attached. It would not matter which support would be attached to which bar support pole because the two supports would have the same dimensions.

FIGS. 9 and 10 show perspective view of the grind bar 2, fully extended, after the supports 12 and 14 have been completely threadably inserted into the bar support poles 8 and 10. For ideal support, the base 62 of each support would be placed perpendicular to the direction of the first bar 4 and the second bar 6 when lined up in order to ensure adequate support for the grind bar 2 when being used. All the mounting brackets and the connectors connecting the first bar 4 to the second bar 6 would be located on the "inner surface," which in this diagram, would become the "bottom surface" of the fully extended grind bar 2. In this position, the fully extended grind bar 2 would allow a user to use the entire length of the top surface of the grind bar to grind or slide across with their in-line skates, skateboards, snowboards, or other similar items.

Another item that could be added to the present invention for added stability would be a pair of flexible washers (not shown). The washers would be inserted between the supports 12 and 14 and the bar support poles 8 and 10 before they would be threadably attached to one another. The washers would help to "lock in" the connection between these parts, especially as the invention gets used over time.

What I claim as my invention is:

1. A collapsible grind bar having at least two positions, a collapsed position and an extended position, the collapsible grind bar comprising:

(a) a pair of bars, a first bar and a second bar, each bar having two ends, a first end and a second end, each having bar having at least two surfaces, an outer surface and an inner surface, the second end of the first bar being pivotally connected to the second end of the second bar, (b) a pair of support poles, a first support pole and a second support pole, each support pole having two ends, a first end and a second end, the first end of the first support pole being attached to the inner surface of the first bar, the first end of the second support pole being attached to the inner surface of the second bar, (c) means for keeping the collapsible grind bar in a collapsed position, (d) a pair of supports, a first support and a second support, each support comprising a circular section having two ends, a first end and a second end, each support further comprising a base attached to the second end of the circular section, each support further comprising a threaded extension attached to the first end of the circular section, the pair of supports being stored in between the first bar and the second bar of the collapsible grind bar when the collapsible grind bar is in a collapsed position, (e) means for removably attaching the pair of supports to the first bar and the second bar of the collapsible grind bar when the collapsible grind bar is in a collapsed position, and (f) means for supporting the collapsible grind bar while the collapsible grind bar would be in an open position.

2. A collapsible grind bar according to claim 1 wherein the means for keeping the collapsible grind bar in a collapsed position further comprises (a) a pair of holes, a first hole and a second hole, the first hole located on the first bar near the first end of the first bar, the first hole having two ends, a first end and a second end, the first end of the first hole located on the outer surface of the first bar, the second end of the first hole located on the inner surface of the first bar, the second hole located on the second bar near the first end of the second bar, the second hole having two ends, a first end and a second end, the first end of the second hole located on the outer surface of the second bar, the second end of the second hole located on the inner surface of the second bar, (b) a pair of pins, a first pin and a second pin, each pin having two ends, a first end and a second end, the first end of the first pin being inserted through the first end of the first hole on the first bar, the first end of the second pin being inserted through the first end of the second hole on the second bar, (c) wherein the first end of the first pin would be attached to the first end of the second pin.

3. A collapsible grind bar according to claim 1 wherein the first end of the first pin would be removably attached to the first end of the second pin.

4. A collapsible grind bar according to claim 1 wherein the first end of the first pin would be threadably attached to the first end of the second pin.

5. A collapsible grind bar according to claim 1 wherein the means for removably attaching the pair of supports to the first bar and the second bar of the collapsible grind bar when the collapsible grind bar is in a collapsed position further comprises:

(a) a first pair of brackets comprising a first bracket and a second bracket, the first pair of brackets being attached to the inner surface of the first bar, (b) a second pair of brackets comprising a first bracket and a second bracket, the second pair of brackets being attached to the inner surface of the second bar, (c) a first placement hole located on the inner surface of the second bar, (d) a second placement hole located on the inner surface of the first bar, (e) wherein the base of the first support would be placed against the inner surface of the first bar in between the two brackets of the first pair of brackets, and further wherein the threaded extension of the first support would be placed within the first placement hole located on the inner surface of the second bar, and (f) further wherein the base of the second support would be placed against the inner surface of the second bar in between the two brackets of the second pair of brackets, and further wherein the threaded extension of the second support would be placed within the second placement hole located on the inner surface of the first bar.

6. A collapsible grind bar according to claim 1 wherein the means for supporting the collapsible grind bar in an open position further comprises:

(a) the first support, (b) the second support, (c) a pair of threaded holes, a first threaded hole and a second threaded hole, the first threaded hole being located on the second end of the first support pole, the second threaded hole being located on the second end of the second support pole, (d) wherein the first bar and the second bar would be fully extended to the point where the second end of the first bar would abut the second end of the second bar, (e) further wherein the threaded extension on the first support would be threadably attached to the first threaded hole, (f) further wherein the threaded extension on the second support would be threadably attached to the second threaded hole, (g) and further wherein the base of the first support and the base of the second support would be placed on a ground surface.

7. A collapsible grind bar according to claim 1 wherein the first bar and the second bar would have a rectangular cross-section.

8. A collapsible grind bar according to claim 1 wherein the collapsible grind bar, while in an open position, would not be fixedly attached to the ground surface.

* * * * *